US005746260A

United States Patent [19]

Vesborg

[11] Patent Number: 5,746,260

[45] Date of Patent: *May 5, 1998

[54] CONTAINER SET COMPRISING AT LEAST TWO CONTAINERS

[75] Inventor: Steen Vesborg, Gentofte, Denmark

[73] Assignee: Colgate-Palmolive Company, New York, N.Y.

[ * ] Notice: The term of this patent shall not extend beyond the expiration date of Pat. No. 5,533,553.

[21] Appl. No.: 376,948

[22] Filed: Jan. 19, 1995

Related U.S. Application Data

[63] Continuation-in-part of Ser. No. 186,722, Jan. 26, 1994, Pat. No. 5,533,553.

[30] Foreign Application Priority Data

Jan. 27, 1994 [DK] Denmark ..... 0115/94

[51] Int. Cl.[6] ..... B65B 1/04

[52] U.S. Cl. ..... 141/319; 141/366; 141/114

[58] Field of Search ..... 141/319, 320, 141/363, 364, 365, 366, 375, 114; 215/DIG. 8, 381, 382, 12.1, 900; 222/567, 109, 111; 285/332, 345; 220/666, 669, 675, DIG. 12, DIG. 13

[56] References Cited

U.S. PATENT DOCUMENTS

| | | | |
|---|---|---|---|
| 2,022,520 | 11/1935 | Philbrick | 215/382 |
| 2,433,989 | 1/1948 | Hansen | 141/363 X |
| 2,543,724 | 2/1951 | Iwanowski | 141/367 X |
| 2,773,521 | 12/1956 | Persson | 141/319 X |
| 3,261,381 | 7/1966 | Roach | 141/319 X |
| 3,321,096 | 5/1967 | Hebel | 215/382 |
| 4,573,506 | 3/1986 | Paoletti | 141/98 |
| 4,614,437 | 9/1986 | Buehler | 366/130 |
| 4,773,560 | 9/1988 | Kittscher | 222/109 |
| 4,844,957 | 7/1989 | Hoffman | 215/12.1 |
| 4,917,268 | 4/1990 | Cambell et al. | 722/109 |
| 4,946,053 | 8/1990 | Conrad | 215/382 |
| 5,101,990 | 4/1992 | Krishnakumar et al. | 220/675 |
| 5,285,824 | 2/1994 | Krstovic | 141/319 X |

FOREIGN PATENT DOCUMENTS

| | | |
|---|---|---|
| 0109704 | 5/1984 | European Pat. Off. . |
| 0230273 | 7/1987 | European Pat. Off. . |
| 0421539 | 4/1991 | European Pat. Off. . |
| 3343993 | 6/1985 | Germany . |
| 8811084 | 12/1989 | Germany . |
| 9004964 | 8/1991 | Germany . |
| 1074162 | 6/1967 | United Kingdom . |

*Primary Examiner*—J. Casimer Jacyna
*Assistant Examiner*—Steven O. Douglas
*Attorney, Agent, or Firm*—Michael McGreal

[57] ABSTRACT

A container set comprises a first container (21) adapted to be reused by being refilled with the contents of a second container (22) containing a product of a volume not exceeding the volume of the first container. The two containers (21 and 22) comprise mouth parts (33, 27) with guide faces allowing a coupling together of the containers in a position in which said containers are mutually immovable in radial direction. Furthermore, the mouth parts (33, 27) of the containers (21, 22) comprise co-operating sealing faces preventing the contents from leaking into the surroundings when the coupled containers are manipulated in order to transfer the contents from the second container (22) to the first container (21). The second container (22) preferably has a substantially superelliptic shape in any cross-sectional view parallel to the support engaging force of the container when the container is filled with the liquid product.

15 Claims, 7 Drawing Sheets

CONTAINER SET COMPRISING AT LEAST TWO CONTAINERS

This application is a continuation-in-part of my prior application Ser. No. 8/186,722, now U.S. Pat. No. 5,533,553, filed Jan. 26, 1994.

The invention relates to a container set comprising at least two containers, where a first container is adapted to be reused by way of being refilled with the contents of a second container containing a product of a volume not exceeding the volume of the first container, each of the containers comprising mouth parts with an opening portion allowing free passage of the contents when the containers are used. The second container can be a thin walled container having a superelleptic shape when filled.

BACKGROUND ART

It is often a problem to pour the contents from one container into another container without spilling. Especially liquid contents involve problems when the container from which the liquid is to be poured comprises a thin walled container with soft walls because the pouring cannot be controlled when the user presses too hard on the soft walls. The pouring of other flowable products, such as powdered and granular products can, however, also involve problems or cause inconvenience, for instance in the form of dust. The growing interest in delivering flowable products in very thin-walled containers that are difficult to handle has created an increasing demand for refilling a re-usable container with the liquid product without problems, said re-usable container being easy and reliable to handle. There also is an increasing demand for minimizing the amount of plastic material in packages.

SUMMARY OF THE INVENTION

One object is to provide a blow molded thin walled package having a superelleptic shape when filled which minimizes the plastic content for a given volume.

Another object of the invention is to provide a container set of the above type which allows a filling of the contents of a thin walled container that is difficult to handle into a re-usable container being easy to handle without spilling the contents.

In satisfaction of the first object, the package according to the invention is characterized in that the side wall of the container comprises two pairs of opposing side wall portions which in any sectional view parallel to the support engaging face of the container is of a substantially superelliptic shape when the container is filled with the flowable product.

By a superelliptic shape is meant a curve positioned on a superellipse generally expressed by the formula:

$$\left(\frac{x}{a}\right)^p+\left(\frac{y}{b}\right)^p=1$$

where $2a$=the length of the major axis, $2b$=the length of the minor axis, and p>2 when the container is filled with the product.

The exponent p of the superellipse may according to the invention be in the range 2.1 to 10, preferably 2.4 to 5. Tests and calculations have shown that for instance the exponents 2.5 and 3.5 are particularly advantageous. Moreover, the axes b of the superellipse may be in the range 0.5 to 1, where $2a$ is the length of the major axis and $2b$ is the length of the minor axis. In practice, the ratio of the axes is determined by the number of containers which shall be placed on a specific surface area, such as in a cardboard box. In order to obtain the smallest possible surface area relative to the circumscribing volume, the ratio of the axes should, however, be as close to 1 as possible resulting in the lowest possible material consumption in connection with-blow molding of the container.

In addition, the ratio of the axes c/a of the longitudinal sectional superellipse may according to the invention be in the range 0.5 to 5, where $2c$ is the length of the major axis perpendicular to the support engaging face, and $2a$ is the length of the major axis of the cross-sectional superellipse.

In satisfaction of the latter object, the container set is characterized in that the mouth parts of the first and the second container comprise guide means allowing a coupling together of the containers in a position in which the containers are mutually immovable at least in the radial direction and in which the opening portions allow a free passage of the contents from the first container into the second container, the mouth parts of the two coupled containers comprising co-operating anti-leak means preventing the contents from leaking into the surroundings at least during passage of the contents from the second container to the first container. The second container will preferably be of a superelliptic shape.

In this manner it is possible without spilling to fill the contents of the second container into the first container by proceeding according to the following procedure: placing the second container in an upright position, turning the first container, i.e. the re-usable container, upside down and causing the guide faces of the two containers to engage one another so as to enter the coupled position in which they are immovable in the radial direction, turning the two containers upside down while maintaining the coupled position in such a manner that the second container is on top, whereby the contents of the second container flows downwards into the first container, causing the second container to disengage the re-usable container, whereafter said re-usable container being easy to handle can be used for pouring out the contents.

While the contents of the second container flow into the re-usable container the anti-leak means prevent the contents from leaking into the surroundings.

The guide means of the container may comprise an outer guide face on the mouth part of one container, where the outer guide face co-operate in a guiding manner with an inner guide face on the mouth part of the other container, preferably one of the guide faces is positioned on a face tapered in the coupling direction of the containers. As a result, the containers are reliably guided into the coupled position in which they are fixed in radial direction. The tapering face may advantageously be of such a tapering that a self-sealing effect is obtained between the co-operating guide faces.

In connection with the above embodiment of the invention, the outer guide face may be formed by the apex of an external thread on the mouth part of the second container. As the second container in many cases comprises a neck with an external thread, it is possible to reduce the total height of the container by using the thread apexes as guide faces compared to the situation where separate guide faces are to be provided on said neck.

Moreover, the co-operating anti-leak means on the mouth parts of the containers may comprise co-operating sealing faces also preventing the contents from leaking into the surroundings during the passage from the first container into the second container. This embodiment of the invention has the advantage that liquid cannot leak into the surroundings irrespective of the orientation of the containers in their coupled position, i.e. liquid cannot leak either when the first container is on top while filled with liquid.

In connection with the above embodiment of the invention at least one of the sealing faces may be a tapered face. This embodiment of the invention is considered to be particularly advantageous, especially when a rather small tapering angle is used because then the two sealing faces are pressed sealingly against one another in the coupled position of the containers. Furthermore, the sealing faces and the guide faces on the two containers of this embodiment of the invention may advantageously be formed by the same faces.

Furthermore, the two mouth parts may comprise co-operating fastening means for a detachable mutual fastening of the two containers in their coupled position. In this manner, the risk of the containers being inadvertently caused to disengage one another in their coupled position during the filling procedure has been eliminated.

In addition, the fastening means may be threads. This embodiment renders it possible to utilize the thread for a cap as fastening means of either the first container or the second container.

Furthermore, the mouth parts of the two containers may comprise co-operating stop faces adapted to abut one another in the coupled position of the two containers and consequently defining said position in the axial direction. Moreover, the mouth part of the first container may comprise a circumferential wall, on the inner side of which the guide means of the first container is arranged, and the mouth part of the second container may comprise a circumferential outwardly extending wall, on the outer side of which the guide means of the second container is position.

Additionally, the circumferential wall of the mouth part of the first container may in connection with the above embodiment of the invention comprise an inwardly extending bottom wall at a lower end, said bottom wall continuing into a spout-forming, upwardly extending wall, and an opening to the interior of the container may be provided in the lower portion of the annular compartment formed by said three walls.

BRIEF DESCRIPTION OF DRAWINGS

The invention is explained in greater detail below with reference to the accompanying drawings, in which.

DESCRIPTION OF PREFERRED EMBODIMENTS

Figure 1:
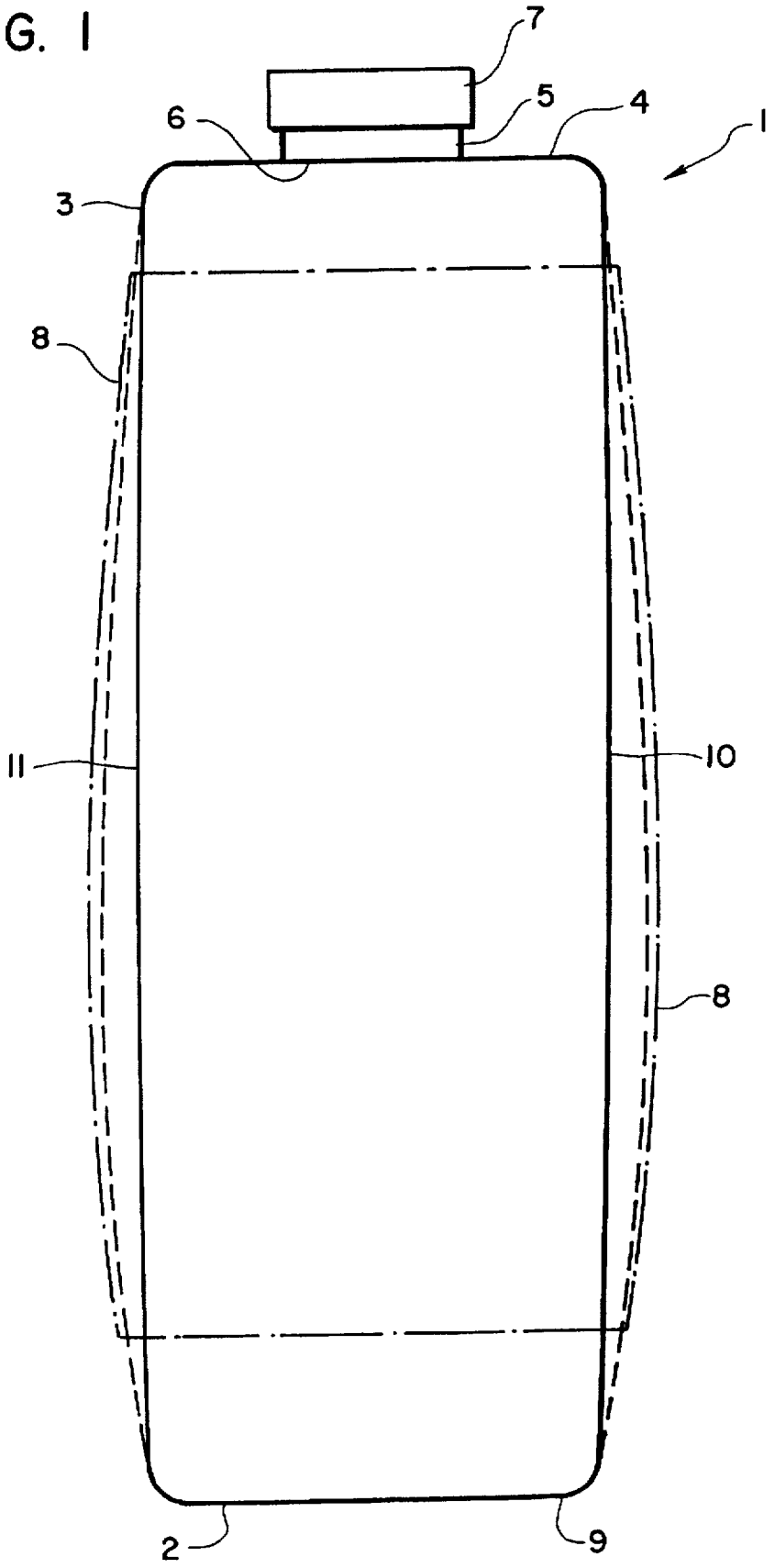
FIG. 1 is a diagrammatic side view of a package according to the invention.
Figure 2:
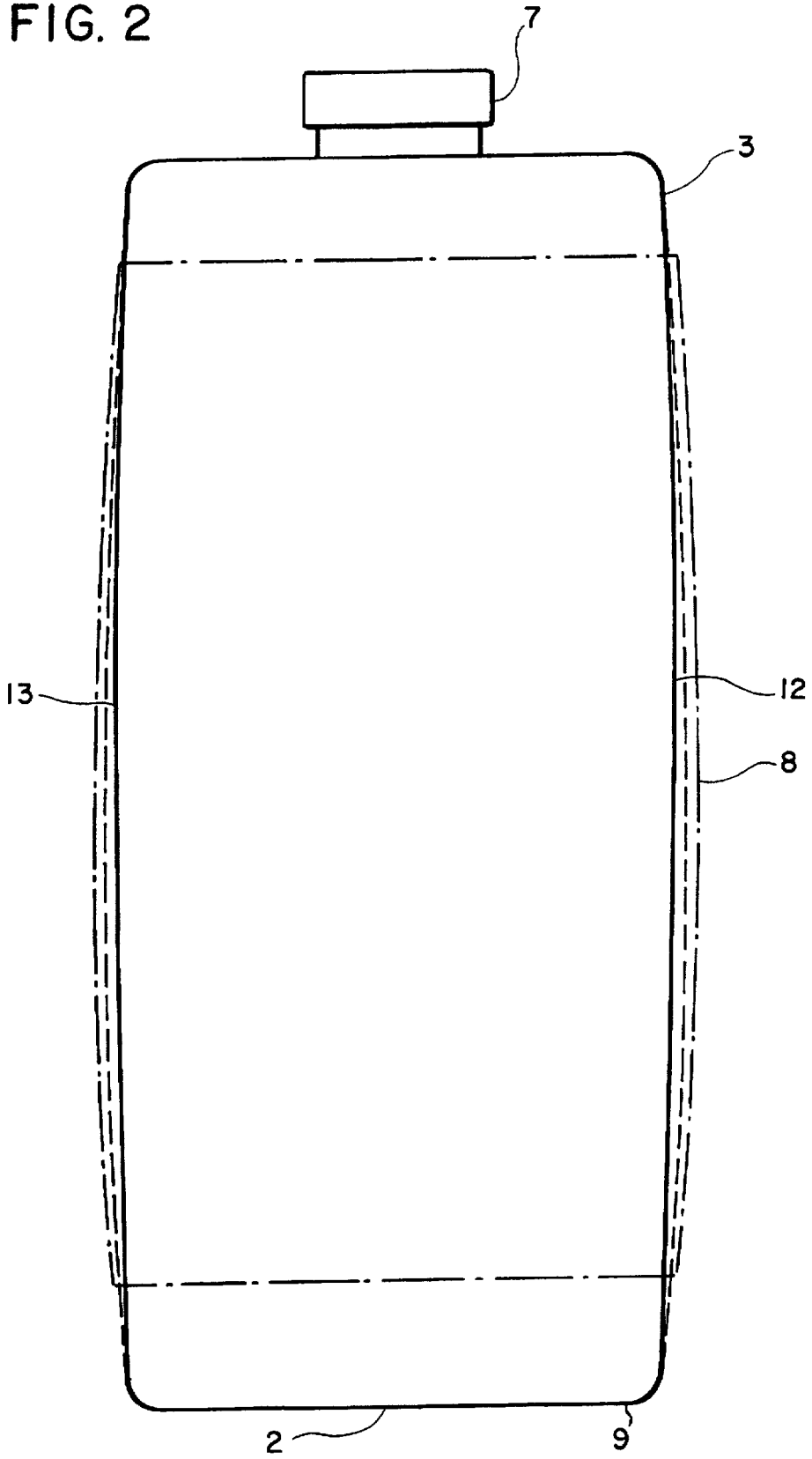
FIG. 2 is a front view of the package of FIG. 1.
Figure 3:
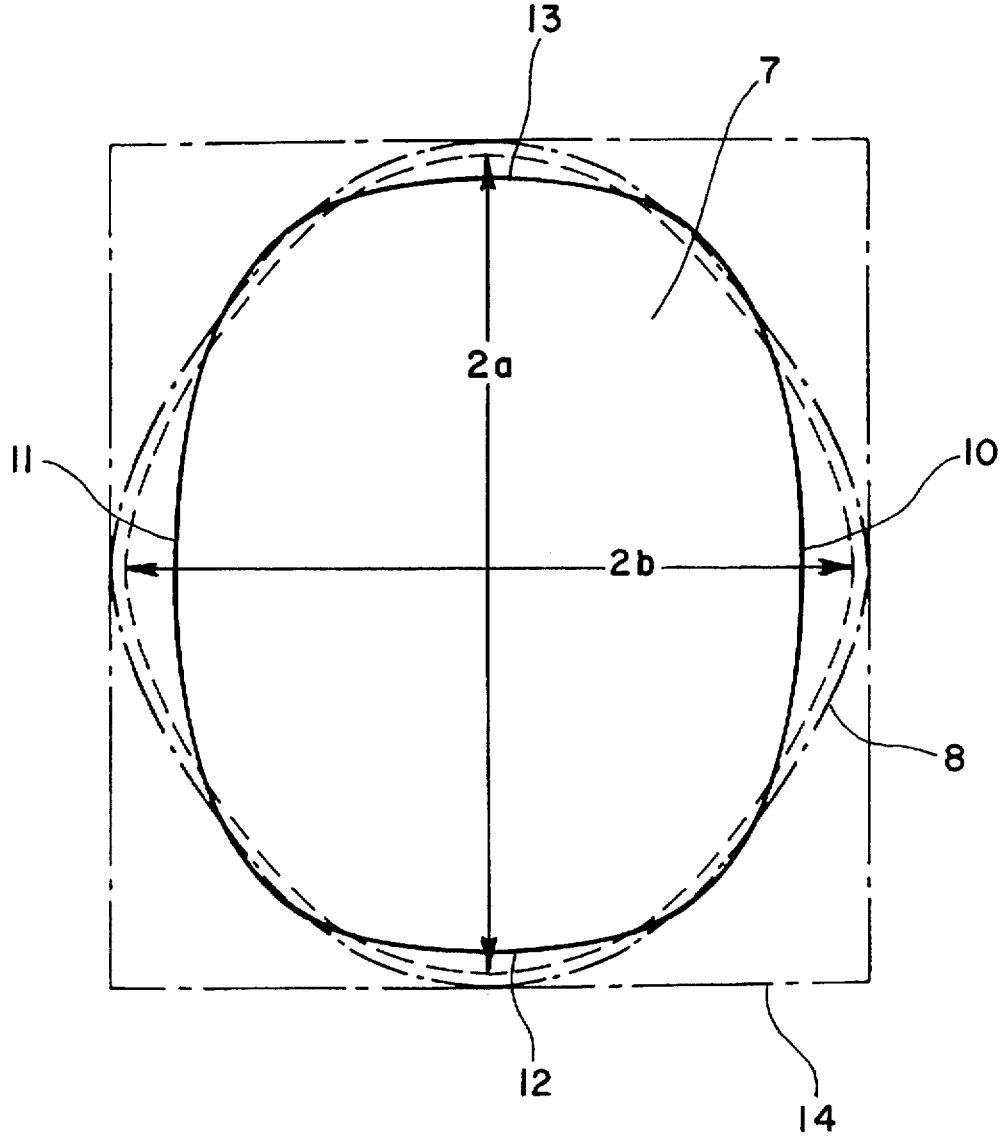
FIG. 3 is a top view of the package of FIGS. 1 and 2.

The package shown in FIGS. 1 to 3 comprises a container 1 filled with a flowable product, such as a liquid or a powdered product. The product can for instance be a liquid fabric softener or detergent or a powdered detergent.

The container comprises a bottom wall 2 forming a support engaging face 9 intended to engage the support on which the container rests. A circumferential side wall 3 extends upwards from the bottom wall 2. The side wall 3 continues into an upper wall 4. The side wall comprises two pairs of opposing side wall portions 10, 11, 12, 13. The upper wall 4 comprises an opening portion in form of a neck 5 defining a container opening 6. The opening portion is closed by means of a closure means in form of a cap 7. The cap 7 is typically a screw cap with an internal thread engaging an external thread on the neck 5.

The hydrostatic pressure of the product in the container and optionally an inner gas pressure have the effect that the container filled with liquid and optionally closed by means of the cap has a different shape than an empty container, said filled state being shown in an exaggerated way for illustrative reasons by means of dotted lines and said empty state being indicated by means of solid lines. In the filled state of the containers the circumferential side wall 3 is of a substantially superelliptic shape in any cross-sectional view parallel to the support engaging face of the bottom wall 2, which appears particularly clearly from FIG. 3. Furthermore, in the filled state of the container, the circumferential side wall 3 is of a superelliptic shape in any longitudinal sectional view perpendicular to the support engaging face and parallel to the major axis a of the cross-sectional superellipse as well as in any longitudinal sectional view parallel to the minor axis b of said cross-sectional superellipse, cf. FIGS. 1 and 2.

Finally, the package shown in the drawing comprises a sleeve 8 of a shrinkable plastic material shrunk on the outer face of the circumferential side wall 3 after filling of the container 1 with the desired product. The object of the sleeve 8 of a shrinkable plastic material is to prevent a plastic deformation of the container when said container is very thin-walled.

The container 1 is, as previously indicated, manufactured by way of blow molding of plastics, i.e. either by way of extrusion blow molding or by way of injection blow molding. The plastic material can for instance be polyethylene, polypropylene or polyvinyl chloride. Stable, polyethylene containers of 0.5 liter without a sleeve have been produced with a wall thickness of 0.3 mm corresponding to a total weight of 14 g. Correspondingly, stable, polyethylene containers of 1 liter have been produced with a wall thickness of 0.5 mm corresponding to a total weight of approximately 22 g. By way of comparison, it should be mentioned that conventionally designed and manufactured containers containing 0.5 liter usually weigh 28 to 30 g and conventional containers containing 1 liter 40 to 45 g.

The size of the base 14 of a straight parallelepipidum, in which the filled container is to be inscribable, is determined on the basis of the number of filled packages to be arranged on a predetermined face area, such as on a pallet, cf. FIG. 3. Based on the selected parallelepipidum as the outer limit, the outer shape of the container in the filled state is chosen, said container being of a superelliptic shape in a horizontal cross-sectional view and preferably also in a vertical sectional view perpendicular to the support engaging face and parallel to the axes of the cross-sectional superellipse as described above.

Figure 4:
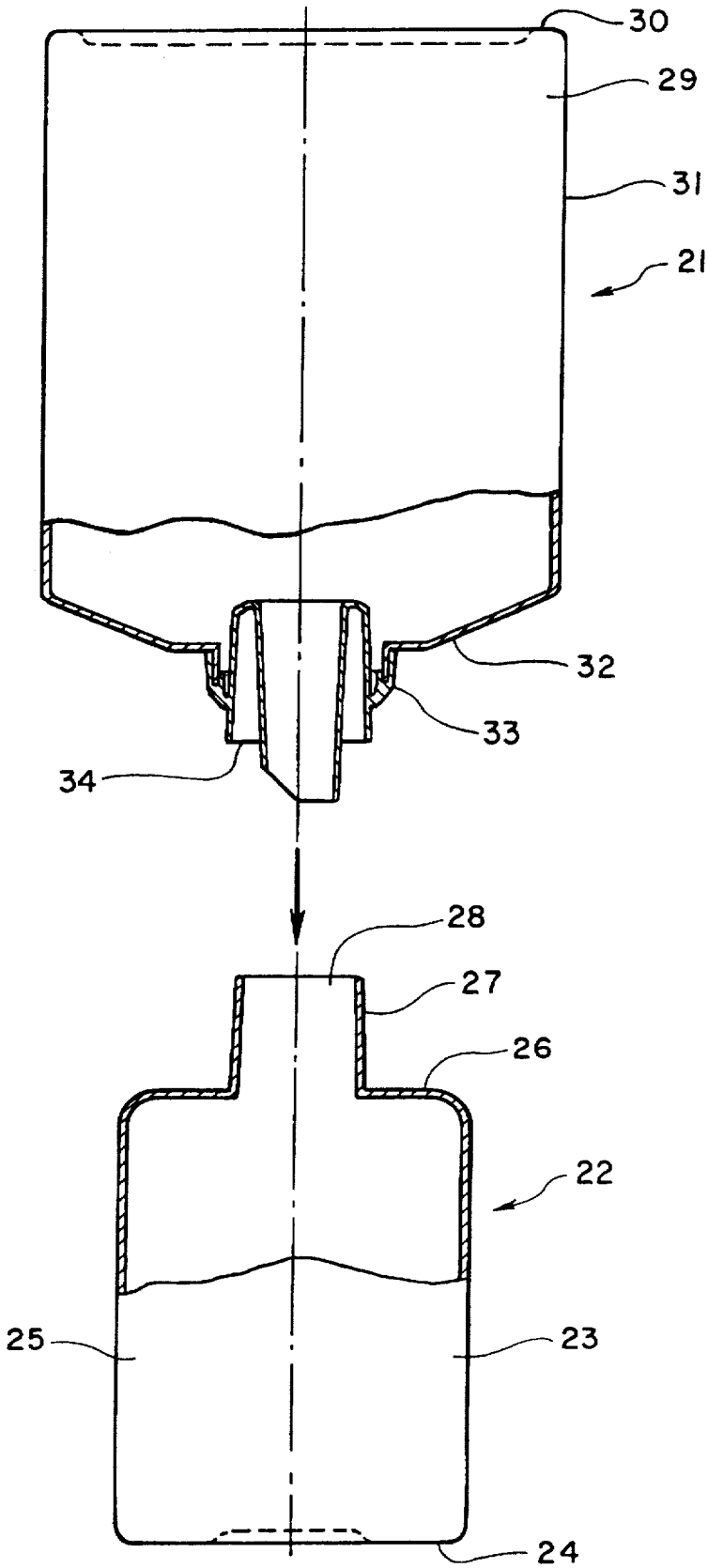
FIG. 4 is a diagrammatic side view, partly in section, of a container set according to the invention, FIG. 5 illustrate the containers of FIG. 4 in a coupled position and turned 180°.

FIG. 4 illustrates a container set comprising a first container 21 and a second container 22, where the first container is turned upside down and the second container is in the upright position. The first container is adapted to be re-used by being filled with the contents of the second container, which is a so-called disposable refill container. The second container 21 is of a smaller volume than the first container.

The second container 21 comprises a container body 23 formed by a bottom wall 24, a circumferential side wall 25, and an upper wall 26. A mouth part or neck 27 extends outwardly from the upper wall and defines a mouth opening 28. The second container 22 is preferably a very thin-walled plastic container and preferably will be of a superelliptic shape and be produced by way of blow or injection molding. The second container can, however, also be provided with a container body of plastic foil, cardboard, metal etc., a separate mouth part being arranged thereon.

The first container 21 comprises a container body 29 formed by a bottom wall 30, a circumferential side wall 31, and an upper wall 32. The upper wall 32 comprises a mouth part 33 defining an opening area 34 into the interior of the container.

As explained in greater detail below, the mouth part 27 of the second container comprises an outer conical surface adapted to guidingly and sealingly engage an inner conical surface on the mouth portion 33 of the first container 21. The coupled position of the two containers, in which their mouth portions 27 and 33 engage one another, is shown in FIG. 5, the coupling of the containers here being turned 180° relative to the position shown in FIG. 4.

Figure 5:
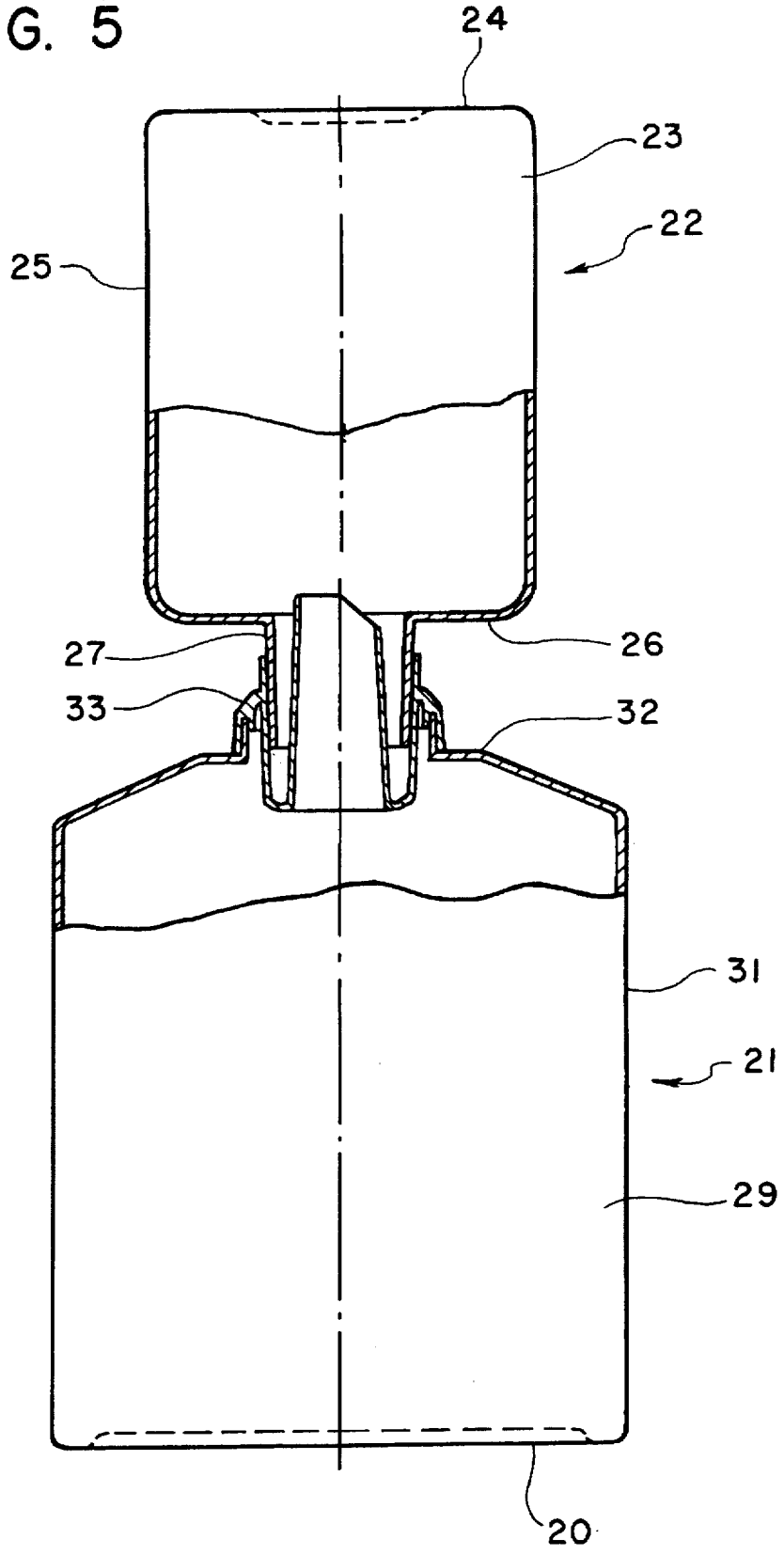

Reference is made to FIGS. 4 and 5, where the contents of the second container 22 is poured into the first container 21 by proceeding according to the following procedure:

The second container 22 is placed in an upright position, such as by standing on a plane base, the first container is taken to be emptied of its contents and it is placed upside down over the second container, the second container is approached the first container in such a manner that the mouth part 33 of the second container is caused to engage the mouth part 28 of the first container with the result that the containers enter a fixed position in radial direction relative to one another. By this embodiment of the invention the co-operating conical surfaces on the two mouth parts 28, 33 provide the above radial fixing at the same time as they also define the coupling position in the axial direction, while maintaining the coupled position, the two containers are turned 180° so as to enter the position shown in FIG. 5, where the second container 22 is placed atop the first container. In this position, the contents of the second container 22 flow downwards into the first container 21, when the whole contents of the second container has passed into the first container, said second container is removed and the fist container can then be used for pouring the product contained therein.

Figure 6:
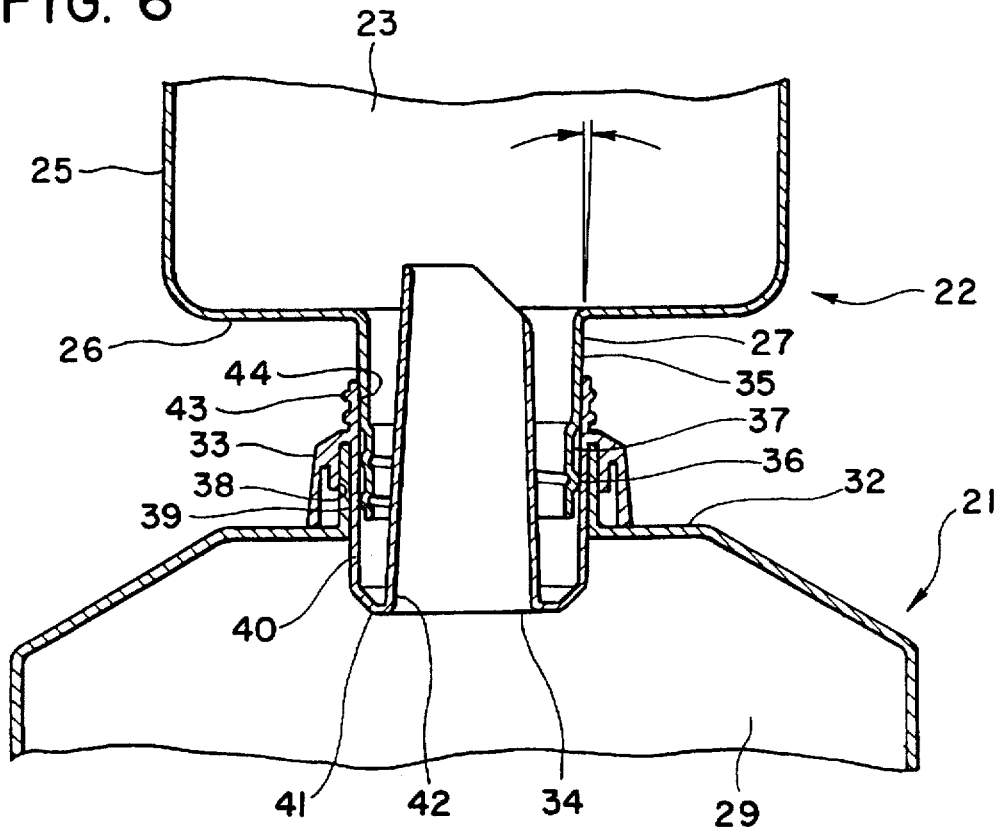
FIG. 6 illustrates on a larger scale the coupling area between the two containers of FIG. 5

As clearly illustrated in FIG. 6, the neck 27 of the second container comprises a conical surface preferably of a tapering of ½° to 2°. The conical surface comprises an inner cone portion 35 formed by a closed face area and an outer cone portion 36 formed by the apexes of an external thread 37.

The mouth part 33 of the first container is formed by a separate part with a downwardly facing annular groove 38 permanently engaging a neck 39 on the container body 29. A circumferential wall 40 is positioned inside the neck 39 of the container body 29 and extends into the interior of the container. At a lower end the wall 40 continues into an inwardly extending bottom wall 41, which in turn continues into an upwardly extending inner wall 42 forming an pouring spout. The inner wall 42 is slotted over its entire length to form an opening extending to the bottom wall 42. At its upper end the circumferential wall 40 comprises an external thread 43 for screwing down a cap not shown on the first container 1.

The inner surface 44 of the circumferential wall 40 tapers inwardly by a tapering of ½° to 2° and forms a combined guiding and sealing face shown in a sealing and guiding engagement with the combined guiding and sealing face 35, 36 on the container 22.

In order to obtain a reliable mutual retaining of the two containers, the inner surface 44 of the circumferential wall 40 can be provided with an internal thread not shown, which is adapted to co-operate with the external thread 37 on the neck 27 of the second container. In this manner it is in addition to a locking engagement between the two containers also possible to obtain a high sealing force between said two sealing faces.

In FIG. 6 the neck 27 of the second container 22 is provided with a thread with the result that it can be closed by means of a cap. However, the neck may also be provided with a closing snap cap or be sealed by means of a terminal wall being cut off when the container is to be opened, which is known in connection with containers containing liquids for medical use.

Figure 7:
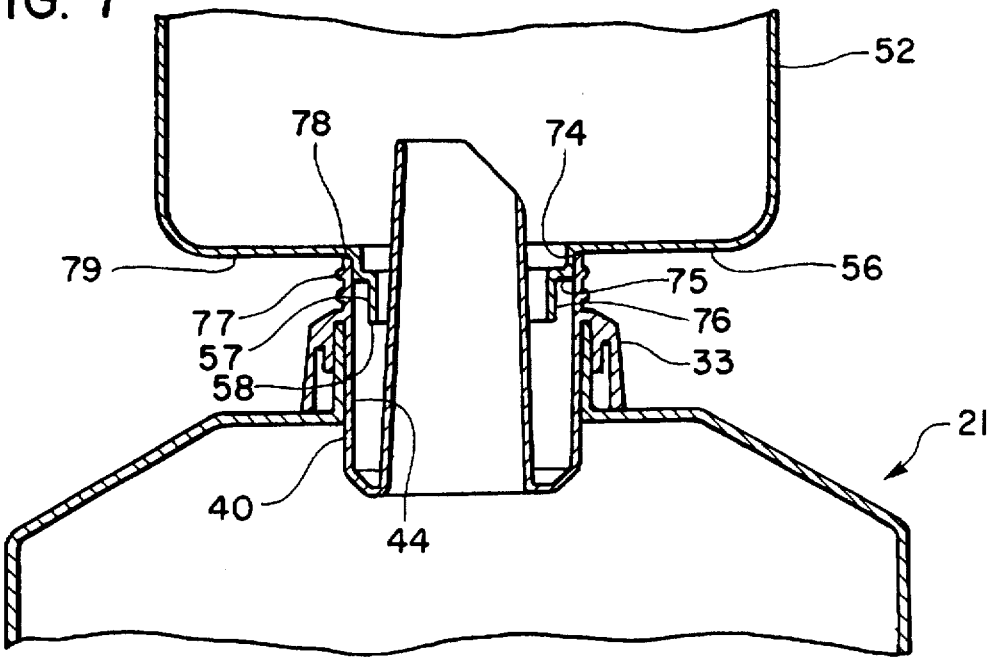
FIG. 7 is a sectional view through the coupling area of a second embodiment of the container set according to the invention.

FIG. 7 illustrates a container set, where the mouth part 33 of the first container 21 corresponds completely to the mouth part 33 described in connection with FIG. 6 and therefore not described in greater detail. The second container 52 corresponds to the second container 22 described in connection with FIG. 6 apart from the shape of its mouth part or neck 27. The mouth part 57 comprises an annular wall 76 extending outwardly from the upper wall 56 and defining the container opening 58. Adjacent the upper wall 56, the annular wall 76 comprises three radially outwardly extending projections 75, only one projection appearing from FIG. 7. The outer surfaces 77 of the outer walls 74 of the projections 75 form a guide means and are arranged on a cone face tapering like the inner surface 44 on the first container 21. Thus the surfaces 44 and 77 of the walls 40 and 74 serve as guide faces guiding the two containers into their radially locked, coupled position. The circumferential wall 40 comprises an upper edge 78. The abutment of this edge 78 against the upper surface 79 of the upper wall 56 of the second container 52 defines the coupled position of the two containers in axial direction. The abutment between the two faces can simultaneously have a sealing purpose when the two faces are shaped as sealing faces.

Figure 8:
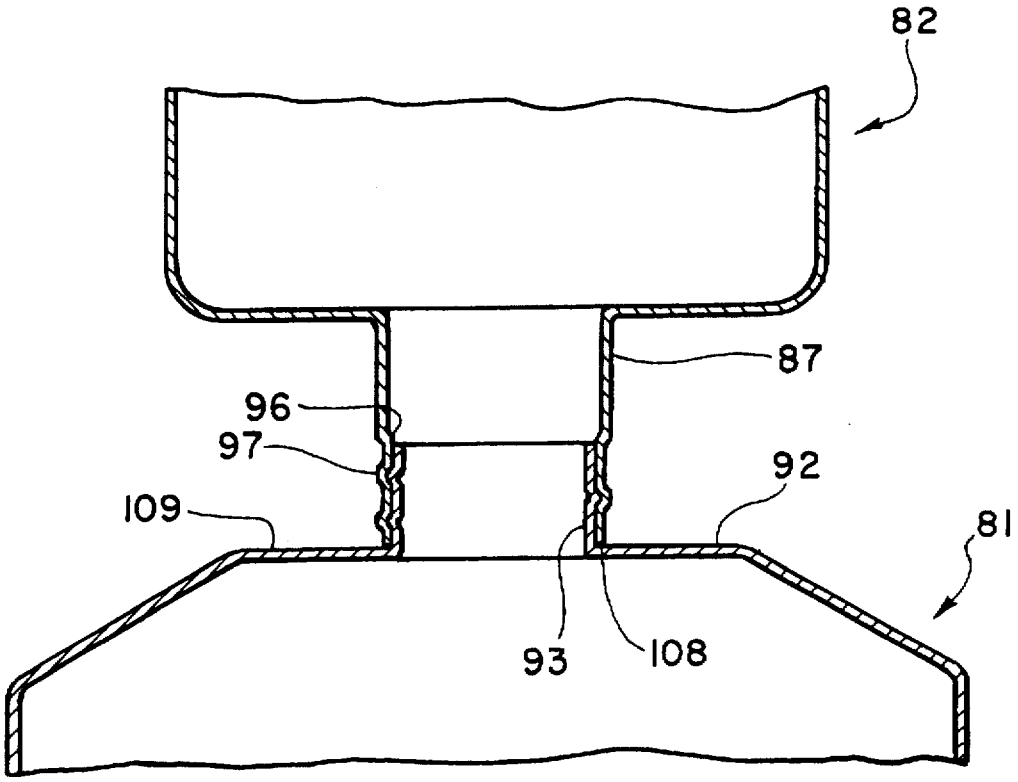
FIG. 8 is a sectional view through the coupling area of a third embodiment of the container set according to the invention.

The embodiment of FIG. 8 comprises a second container 82 with a mouth part 87 provided with both an internal thread 96 and an external thread 97, the apexes of the threads of the external thread being arranged like the apexes of the internal thread, and vice versa. The external thread 97 serves to screw down a screw cap not shown, whereas the internal thread 96 is adapted to engage an external thread 103 on a mouth part 93 of the first container 81. The engagement of the internal thread 96 of the second container 82 and the external thread 83 of the first container provides a reliable interlocking of the two containers. The threads serve simultaneously as guide faces. When the internal thread 96 of the second container 82 is completely screwed down on the external thread 93 of the first container 81, the edge 108 of the mouth part abuts the upper surface 109 of the upper wall 92 of the first container 81. The co-operating surfaces 108 and 109 can serve as sealing faces and define the coupled position of the two containers 81, 82 in the axial direction.

The containers are preferably blowmolded using a thermoplastic resin such as polyethylene polypropylene, polyester such as polyethylene terephthlate polyvinyl chloride or essentially any other thermoplastic which can be blow-molded.

I claim:

1. A container adapted to refill another container comprising a container filled with a flowable product, said container comprising a bottom wall with a support engaging face and a circumferential side wall extending upwards from said bottom wall and continuing at its upper end into an upper wall wherein the side wall of the container comprises two pairs of opposing side wall portions which unfilled is of a first non-super elliptic shape and filled in any sectional view parallel to the support engaging face of the container is of a substantially superelliptic shape expressed by the formula $$\left(\frac{x}{a}\right)^p+\left(\frac{y}{b}\right)^p=1$$

where 2*a* equals the length of the major axis, 2*b* equals the length of the minor axis and p is greater than 2 when said container is filled with the product.

2. A container as in claim 1 wherein the exponent p of the superellipse is in range 2.1 to 10.

3. A container as in claim 1 wherein the b axes of the superellipse is in the range 0.5 to 1 wherein 2*a* is the length of the major axis and 2*b* is the length of the minor axis.

4. A container as in claim 1 wherein the exponent p superellipse is in the range 2.4 to 5.

5. A container as in claim 1 wherein the container further comprises a sleeve of a shrinkable plastic material and shrunk on the outer side of the side wall.

6. A container as in claim 1 wherein said container has a wall thickness of 0.3 mm to 0.5 mm.

7. A container as in claim 6 wherein said container has a volume of 0.5 liter to 1 liter.

8. A container set comprising at least two containers, where a first container is adapted to be reused by way of being refilled with the contents of a second container containing a product of a volume not exceeding the volume of the first container, each of said containers comprising mouth parts with an opening portion allowing free passage of the contents when said containers are used, wherein the first and the second containers comprise guide means allowing a coupling together of said containers to a position, in which said containers are mutually immovable at least in the radial direction and in which the opening portions allow a free passage of the contents from the second container into the first container, said second container comprising a bottom wall with a support emerging face and a circumferential side wall wherein the side wall of the container comprises two pairs of opposing side wall portions which unfilled is of a first shape and filled in any sectional view parallel to the support engaging face of the second container is of a substantially super elliptic shape, expressed by the formula $$\left(\frac{x}{a}\right)^p+\left(\frac{y}{b}\right)^p=1$$

when said container is filled with the flowable product.

9. A container set as in claim 8, wherein the exponent p of the superellipse is in the range 2.1 to 10.

10. A container set as in claim 8, wherein the axes b of the superellipse is in the range 0.5 to 1 where 2*a* is the length of the major axis and 2*b* is the length of the minor axis.

11. A container set as in claim 8, wherein the exponent p of the superellipse is in the range 2.4 to 5.

12. A container set as in claim 8, wherein the second container further comprises a sleeve of a shrinkable plastic material and shrunk on to the outer side of the side wall.

13. A container set as in claim 8 wherein p is greater than 2.

14. A container set as in claim 8 wherein said second container has a wall thickness 0.3 mm to 0.5 mm.

15. A container set as in claim 14 wherein said second container has a volume of 0.5 liter to 1 liter.

* * * * *